US006481405B2

(12) United States Patent
Fujino et al.

(10) Patent No.: US 6,481,405 B2
(45) Date of Patent: Nov. 19, 2002

(54) FUEL SUPPLY CONTROL SYSTEM FOR INTERNAL COMBUSTION ENGINE

(75) Inventors: Hirohide Fujino, Wako (JP); Masaki Ueno, Wako (JP); Masaaki Tomii, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/769,279

(22) Filed: Jan. 26, 2001

(65) Prior Publication Data

US 2001/0010212 A1 Aug. 2, 2001

(30) Foreign Application Priority Data

Jan. 27, 2000 (JP) ..... 2000-019211

(51) Int. Cl.[7] ..... F02D 41/06
(52) U.S. Cl. ..... 123/179.3; 123/491
(58) Field of Search ..... 123/179.3, 491, 123/179.16, 179.17

(56) References Cited

U.S. PATENT DOCUMENTS 4,469,072 A * 9/1984 Kobayashi et al. ..... 123/491
4,478,194 A * 10/1984 Yamato et al. ..... 123/491
4,543,937 A * 10/1985 Amano et al. ..... 123/491
4,582,036 A * 4/1986 Kiuchi et al. ..... 123/491
4,739,741 A * 4/1988 Iwata et al. ..... 123/179.15
4,770,135 A * 9/1988 Jautelat et al. ..... 123/179.17
5,601,604 A * 2/1997 Vincent ..... 606/216
5,634,449 A * 6/1997 Matsumoto et al. ..... 123/478
5,690,074 A * 11/1997 Ogawa ..... 123/491
5,701,871 A 12/1997 Munakata et al. ..... 123/491
6,220,225 B1 * 4/2001 Mencher et al. ..... 123/491

* cited by examiner

*Primary Examiner*—Gene Mancene
*Assistant Examiner*—Arnold Castro
(74) *Attorney, Agent, or Firm*—Arent Fox Kintner Plotkin & Kahn

(57) ABSTRACT

A fuel supply control system for an internal combustion engine wherein during startup of the engine, a fuel supply amount is calculated according to a fuel amount calculating method suitable for startup of the engine, and the calculated amount of fuel is supplied to the engine. After startup of the engine, a fuel supply amount is calculated according to a fuel amount calculating method suitable for after-startup of the engine and the calculated amount of fuel is supplied to the engine, the fuel supply amount during startup of the engine being smoothly changed to the fuel supply amount suitable for after-startup—during the transition from startup to after-startup.

5 Claims, 10 Drawing Sheets

FUEL SUPPLY CONTROL SYSTEM FOR INTERNAL COMBUSTION ENGINE

BACKGROUND OF THE INVENTION

1. Field of the Invention

The present invention relates to a fuel supply control system for an internal combustion engine, and more particularly to a fuel supply control system for controlling a fuel supply amount in a period from startup to warm-up of the engine.

2. Description of the Prior Art

As a fuel supply amount calculating method suitable for the startup of the engine, a method in which a startup basic fuel amount is set according to a temperature of the engine coolant and the startup basic fuel amount is corrected according to the engine rotational speed is conventionally known. Further, a fuel supply amount calculating method suitable for after-startup of the engine (i.e., a method suitable for a condition after completion of the startup), is known in which a basic fuel amount is set according to the engine rotational speed and the intake pressure of the engine and the basic fuel amount is corrected by using various correction coefficients such as an increment correction coefficient set according to elapsed time after startup of the engine and a water temperature correction coefficient set according to the temperature of the engine coolant.

According to the conventional fuel supply control method, the fuel supply amount during startup of the engine is calculated according to the fuel supply amount calculating method suitable for the startup of the engine, and the fuel supply amount after startup is calculated according to the fuel supply amount calculating method suitable for after-startup of the engine, which is different from the method suitable for startup. The fuel supply amount calculating method is switched from the former to the latter upon completion of startup of the engine.

The above-described conventional fuel supply control method, however, has a problem in that it is difficult to allow the exhaust emission characteristic to fall within the exhaust emission regulation at an extremely low level by further reducing the emission amount of undesired components (particularly, an unburned HC component) in the exhaust gases.

Specifically, in order to reduce the emission amount of the unburned HC component emitted from the startup of the engine, it is required to realize optimal combustion by supplying an amount of fuel matched to an amount of intake air from the beginning of the startup. However, according to the conventional control method, the fuel supply amount cannot be controlled with the required accuracy because of the fact that during startup, the fuel supply amount is set only according to the engine temperature and the engine rotational speed, and at the time of completion of startup, the fuel supply amount having been set during startup is immediately changed to a fuel supply amount calculated by the fuel supply amount calculating method suitable for after-startup. Therefore, it is difficult to realize optimal combustion in a period from the startup to the warm-up of the engine.

SUMMARY OF THE INVENTION

Accordingly, an object of the present invention is to provide a fuel supply control system capable of improving the accuracy of control of a fuel supply amount in a period from startup to warm-up of the internal combustion engine, thereby allowing the exhaust emission characteristic to fall within an extremely low level exhaust emission regulation.

To achieve the above object, according to the present invention, there is provided a fuel supply control system for an internal combustion engine comprising startup fuel amount calculating means for calculating, during startup of the engine, a fuel amount to be supplied to the engine according to a fuel amount calculating method suitable for startup of the engine; after-startup fuel amount calculating means for calculating, after startup of the engine, a fuel amount to be supplied to the engine according to a fuel amount calculating method suitable for after-startup of the engine; and fuel supply means for supplying the fuel amount calculated by the startup fuel amount calculating means to the engine during startup of the engine, and supplying the fuel amount calculated by the after-startup fuel amount calculating means to the engine after startup of the engine. The fuel supply means includes transition control means for smoothly performing the transition from the fuel amount calculated by the startup fuel amount calculating means to the fuel amount calculated by the after-startup fuel amount calculating means.

With this configuration, during startup of the engine, a fuel amount is calculated by the fuel amount calculating method suitable for startup, and after startup of the engine, a fuel amount is calculated by the fuel amount calculating method suitable for after-startup, and the transition from the fuel amount calculated by the fuel amount calculating method suitable for startup to the fuel amount calculated by the fuel amount calculating method suitable for after-startup is smoothly performed. Accordingly, both during startup and after startup, the fuel amount suitable for each of the operating conditions is supplied to the engine, and the fuel supply amount is not rapidly changed upon completion of startup of the engine. As a result, it is possible to improve the accuracy of control of a fuel supply amount in a period from startup to warm-up of the engine, and hence to allow the exhaust emission characteristic to fall within an extremely low level exhaust emission regulation.

The transition control means smoothly, preferably performs the transition by correcting each of the fuel amount calculated by the startup fuel amount calculating means and the fuel amount calculated by the after-startup fuel amount calculating means, by using a transition coefficient varying with elapsed time.

With this configuration, since each of the fuel amount calculated by the fuel amount calculating method suitable for startup and the fuel amount calculated by the fuel amount calculating method suitable for after-startup is corrected by using the transition coefficient varying with elapsed time, the transition of the fuel amount can be smoothly performed, and the manner of the transition control can be easily altered by changing the transition coefficient.

The transition coefficient is preferably set according to the number of combustions (e.g. the generated number of TDC signal pulses) in the engine. Alternatively, the transition coefficient may be set according to a count value of a timer.

Preferably, the startup fuel amount calculating means and the after-startup fuel amount calculating means respectively include startup adhesion correcting means and after-startup adhesion correcting means for correcting a delay in transfer of fuel due to adhesion of part of the fuel injected into the intake pipe of the engine, to an inner wall of the intake pipe. The startup adhesion correcting means corrects the fuel amount by using startup adhesion correction parameters and the after-startup adhesion correcting means correcting the fuel amount by using after-starup adhesion correction parameters which are set independently from the startup adhesion correction parameters. The transition control means smoothly performs the transition from the startup adhesion correction parameters to the after-startup adhesion correction parameters by correcting the startup adhesion correction parameters and the after-startup adhesion correction parameters by using a transition coefficient varying with elapsed time.

With this configuration, the fuel amount is corrected during startup by using the startup adhesion correction parameters and the fuel amount is corrected after startup by using the after-startup adhesion correction parameters, and the transition from the startup adhesion correction parameters to the after-startup adhesion correction parameters is smoothly performed by correcting each of the startup adhesion correction parameters and the after-startup adhesion correction parameters by using the transition coefficient varying with elapsed time. Accordingly, both during startup and after startup, the adhesion correction suitable for each of the operating conditions is performed, and the adhesion correction parameters are not rapidly changed upon completion of startup. As a result, it is possible to more accurately control the fuel supply amount in consideration of the fuel adhering to the inner wall of the intake pipe of the engine.

The transition control means preferably sets the transition coefficient according to a temperature of the engine.

With this configuration, the transition coefficient used for the transition control of the transition from the fuel amount calculated according to the fuel amount calculating method suitable for startup to the fuel amount calculated according to the fuel amount calculating method suitable for after-startup is set according to the engine temperature. Accordingly, the rate or the termination time of the transition from the fuel amount calculated according to the fuel amount calculating method suitable for startup to the fuel amount calculated according to the fuel amount calculating method suitable for after-startup changes depending on the engine temperature. As a result, it is possible to perform the transition control optimally adapted to the engine temperature during startup.

The transition control means preferably sets the transition coefficient so that the transition rate becomes faster as the temperature of the engine becomes higher.

The transition control means preferably sets the transition coefficient so that the completion timing of the transition becomes earlier as the temperature of the engine becomes higher.

Preferably, the startup fuel amount calculating means calculates a modified startup basic fuel amount by correcting a startup basic fuel amount set according to the engine rotational speed and the intake pressure by using at least one of a startup intake air temperature correction coefficient set according to the intake air temperature, a startup atmospheric pressure correction coefficient set according to atmospheric pressure, and a startup engine temperature correction coefficient set according to the engine temperature, and calculates the fuel amount to be supplied to the engine during startup by using the modified startup basic fuel amount; and the after-startup fuel amount calculating means calculates a modified after-startup basic fuel amount by correcting an after-startup basic fuel amount set according to the engine rotational speed and the intake pressure by using at least one of an after-startup intake air temperature correction coefficient set according to the intake air temperature, an after-startup atmospheric pressure correction coefficient set according to atmospheric pressure, and an after-startup engine temperature correction coefficient set according to the engine temperature, and calculates the fuel amount to be supplied to the engine after startup by using the modified after-startup basic fuel amount.

The transition control means preferably, smoothly performs the transition from the modified startup basic fuel amount to the modified after-startup basic fuel amount by using a transition coefficient varying with elapsed time.

Other objects and features of the invention will be more fully understood from the following detailed description and appended claims when taken with the accompanying drawings.

DETAILED DESCRIPTION OF THE PREFERRED EMBODIMENT

Hereinafter, a preferred embodiment of the present invention will be described with reference to the drawings.

Figure 1:
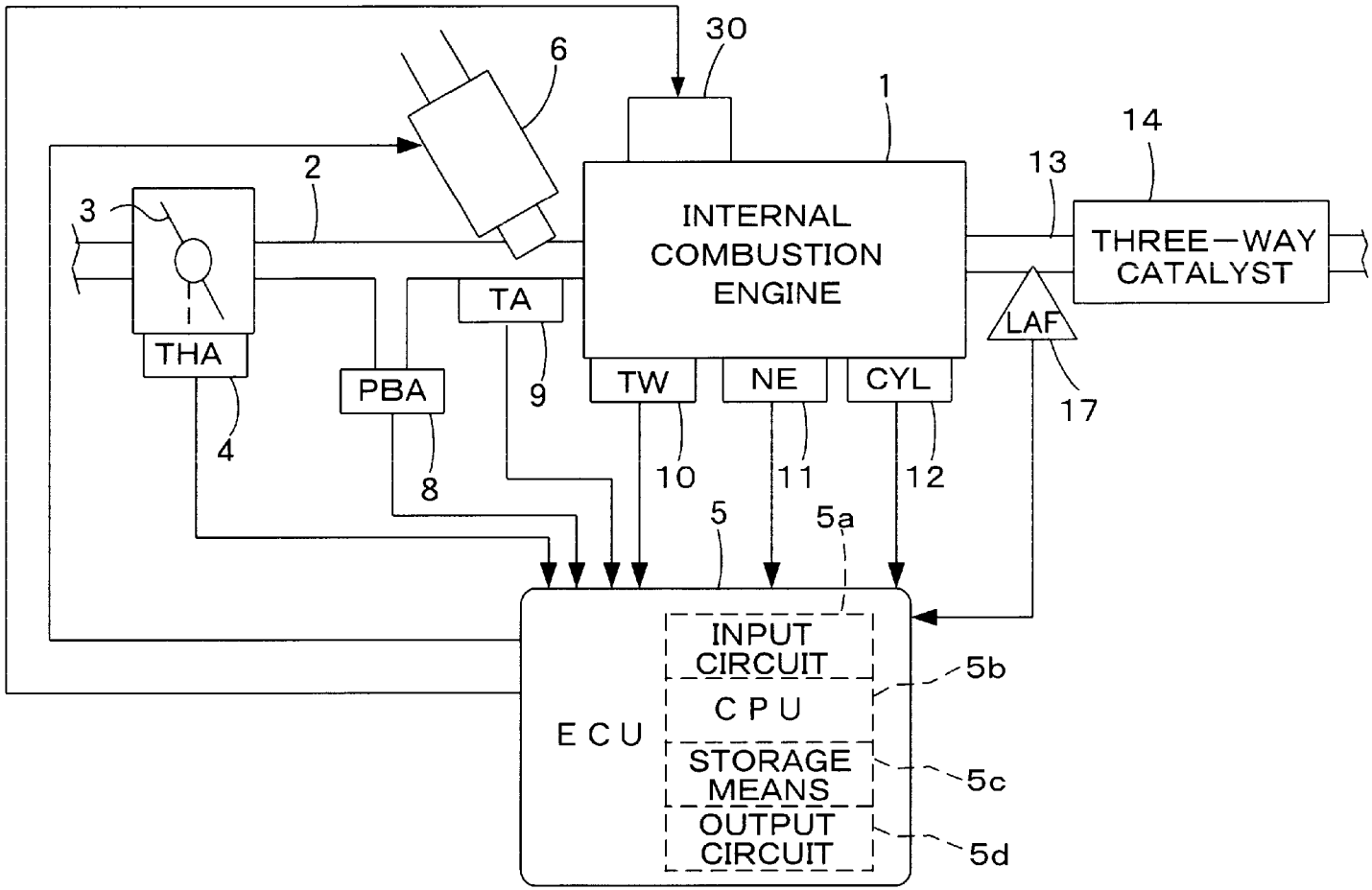
FIG. 1 is a diagram showing a configuration of a control system for an internal combustion engine, including a fuel supply control system according to one embodiment of the present invention.

FIG. 1 is a diagram showing a general configuration of an internal combustion engine (hereinafter, referred to as an "engine") and a control system therefor. The control system includes a fuel supply control system according to one embodiment of the present invention. The engine 1 is, for example, a four-cylinder engine having an intake pipe 2 provided with a throttle valve 3. A throttle valve opening (THA) sensor 4 is connected to the throttle valve 3 to output an electrical signal corresponding to the opening angle of the throttle valve 3, to an electronic control unit (hereinafter, referred to as "ECU") 5 for controlling the engine 1.

A fuel injection valve 6, which is provided for each cylinder to inject fuel into the intake pipe 2, is disposed between the engine 1 and the throttle valve 3 and slightly upstream of an intake valve (not shown). The fuel injection valves are connected to a fuel pump (not shown) and electrically connected to the ECU 5. The valve opening period of each fuel injection valve 6 is controlled by a signal outputted from the ECU 5.

An absolute intake pressure (PBA) sensor 8 is provided immediately downstream of the throttle valve 3 to detect the absolute intake pressure. An absolute pressure signal outputted from the absolute intake pressure sensor is supplied to the ECU 5. An intake air temperature (TA) sensor 9 is mounted downstream of the absolute pressure sensor 8 to detect the intake air temperature TA. The sensor 9 outputs an electrical signal corresponding to the detected intake air temperature, to the ECU 5.

An engine coolant temperature (TW) sensor 10 such as a thermistor, is mounted on the body of the engine 1 to detect the engine coolant temperature (engine cooling water temperature) TW. An electrical signal corresponding to the detected engine coolant temperature is supplied to the ECU 5.

An engine rotational speed (NE) sensor 11 and a cylinder discrimination (CYL) sensor 12 are mounted around a cam shaft or crank shaft (not shown) of the engine 1. The engine rotational speed sensor 11 outputs a TDC signal pulse at a crank angle position located at a predetermined angle before the top dead center (TDC) corresponding to the start of an intake stroke of each cylinder of the engine 1 (at every 180 degree crank angle for a four-cylinder engine). The cylinder discrimination sensor 12 outputs a cylinder discrimination signal pulse at a predetermined crank angle position of a specific cylinder. These signal pulses are supplied to the ECU 5.

A three-way catalyst 14 is provided in an exhaust pipe 13, and a proportional type air-fuel ratio sensor (hereinafter, referred to as an "LAF sensor") 17 is mounted on the exhaust pipe 13 at a position upstream of the three-way catalyst 14. The LAF sensor 17 outputs a detection signal substantially proportional to the concentration of oxygen (air-fuel ratio) in exhaust gases, and supplies the detection signal to the ECU 5.

The engine 1 has a valve timing switching mechanism 30 capable of switching the valve timing of intake valves and exhaust valves between a high-speed valve timing suitable for a high-speed operating region of the engine 1 and a low-speed valve timing suitable for a low-speed operating region of the engine 1. This switching of the valve timing also includes switching of the valve lift amount. Further, when selecting the low-speed valve timing, one of the two intake valves in each cylinder is stopped to ensure stable combustion even in the case of setting the air-fuel ratio lean with respect to the stoichiometric ratio.

The valve timing switching mechanism 30 is of such a type that the switching of the valve timing is carried out hydraulically. That is, a solenoid valve for performing the hydraulic switching and an oil pressure sensor are connected to the ECU 5. A detection signal from the oil pressure sensor is supplied to the ECU 5, and the ECU 5 controls the solenoid valve to perform the switching control of the valve timing according to an operating condition of the engine 1.

The ECU 5 includes an input circuit 5*a* having various functions including the function of shaping the waveforms of input signals from the various sensors, the function of correcting the voltage levels of the input signals to a predetermined level, and the function of converting analog signal values into digital signal values; a central process unit (which will be hereinafter referred to as "CPU") 5*b*; storage means 5*c* preliminarily storing various operational programs to be executed by the CPU 5*b* and for storing the results of computation or the like by the CPU 5*b*; and an output circuit 5*d* for supplying drive signals to the fuel injection valves 6.

Figure 2:
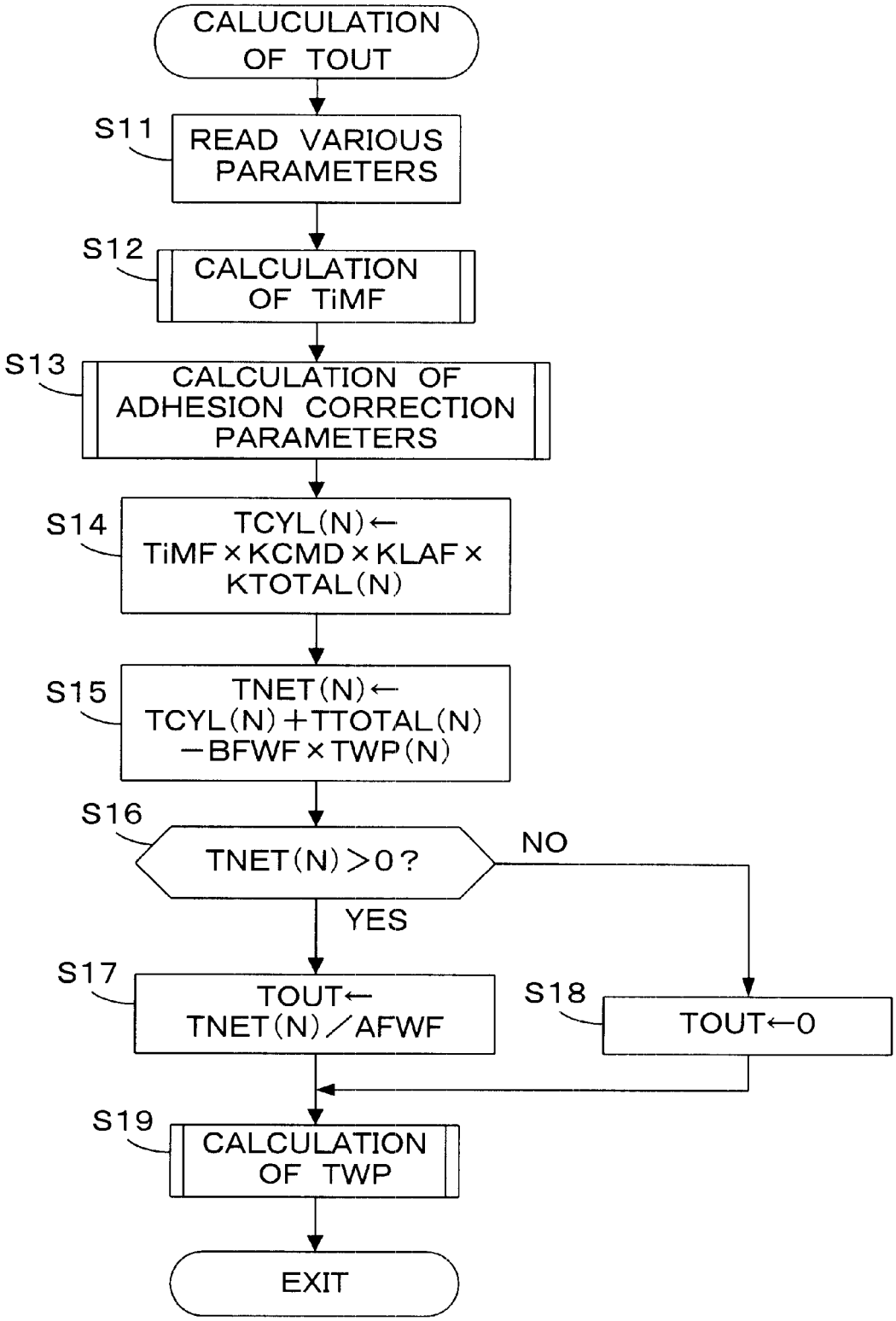
FIG. 2 is a flowchart of a process for calculating a fuel injection time (TOUT)

FIG. 2 is a flowchart of a process for calculating the valve opening period of the fuel injection valve 6, that is, a fuel injection amount TOUT. This process is executed in synchronism with the generation of a TDC signal pulse by the CPU 5*b* of the ECU 5. It should be noted that a fuel amount (fuel injection amount) in this embodiment is calculated as a valve opening period of the fuel injection valve 6; however, since the fuel injection amount is proportional to fuel injection period, the valve opening period is described as the fuel amount or fuel injection amount.

Figure 3:
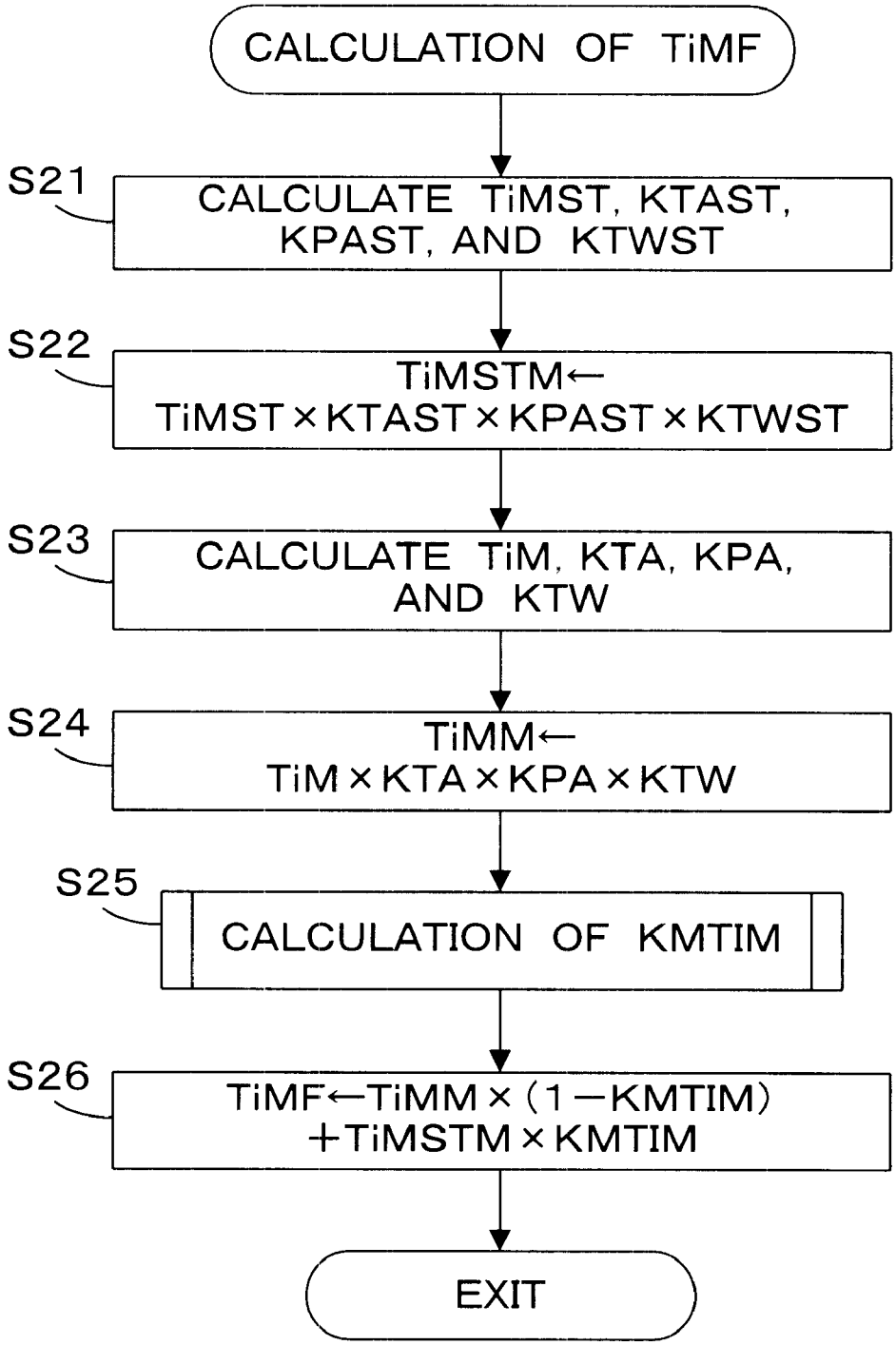
FIG. 3 is a flowchart of a process for calculating a total basic fuel amount (TiMF)

In step S11, engine operating parameters detected by the various engine condition sensors are read out, and a TiMF calculating process shown in FIG. 3 is executed (step S12). In this process, a startup basic fuel amount TiMST and an after-startup basic fuel amount TiM are calculated and corrected according to the intake air temperature TA, the atmospheric pressure PA, and the engine coolant temperature TW, and then, a total basic fuel amount TiMF is calculated by correcting each of the startup basic fuel amount TiMST and the after-startup basic fuel amount TiM by using a transition coefficient KMTIM for smoothly performing the transition from the fuel supply amount suitable for startup to the fuel supply amount suitable for after-startup.

Figure 6:
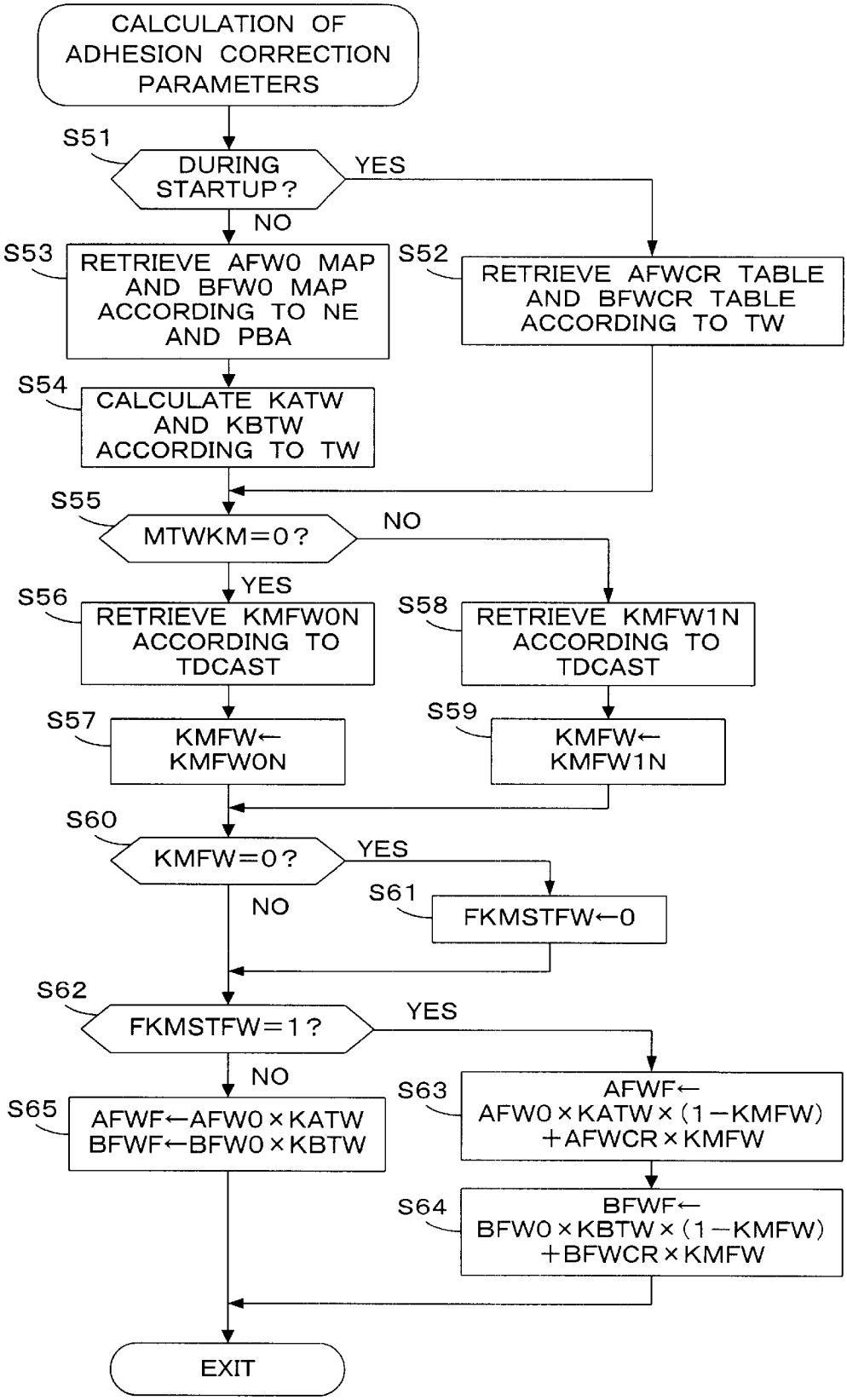
FIG. 6 is a flowchart of a process for calculating adhesion correction parameters.

In step S13, an adhesion correction parameter calculating process shown in FIG. 6 is executed. In this process, adhesion correction parameters, that is, a direct supply ratio AFWF and a carried-away ratio BFWF, which are used for correcting a delay in the transfer of fuel due to adhesion of part of the fuel injected from the fuel injection valve 6 to an inner wall of the intake pipe 2, are calculated. The direct supply ratio AFWF is defined as a ratio of the amount of fuel supplied directly to the combustion chamber during a cycle in which the fuel injection is carried out, to the amount of fuel injected into the intake pipe, and the carried-away ratio BFWF is defined as the ratio of an amount of fuel supplied to the combustion chamber by evaporation or the like during a certain cycle, to the amount of fuel adhered to the inner wall of the intake pipe during previous cycles.

In step S14, the required fuel amount TCYL(N) is calculated according to the following equation (1):

$$TCYL(N)=TiMF\times KCMD\times KLAF\times KTOTAL(N) \quad (1)$$

where (N) indicates that the parameter to which (N) is affixed is calculated corresponding to each cylinder. TiMF is the total basic fuel amount calculated in step S12. KCMD is a target air-fuel ratio coefficient set according to engine operating parameters such as the engine rotational speed NE, the throttle valve opening THA, and the engine coolant temperature TW. KLAF is the air-fuel ratio correction coefficient set according to the output from the LAF sensor 17. KTOTAL(N) is the product of other correction coefficients calculated according to the engine operating parameters supplied from the various sensors (excluding intake air temperature correction coefficients KTA and KTAST, atmospheric pressure correction coefficients KPA and KPAST, and engine coolant temperature correction coefficients KTW and KTWST (these coefficients will be described later), as well as the target air-fuel ratio coefficient KCMD and air-fuel ratio correction coefficient KLAF).

It should be noted that during startup of the engine, each of the air-fuel ratio correction coefficient KLAF and the product KTOTAL(N) of the other correction coefficients is set at a predetermined value (e.g. 1.0).

In step S15, a direct supply fuel amount TNET(N) as a fuel amount to be directly supplied to the combustion chamber in the present cycle, is calculated by applying the required fuel amount TCYL(N) calculated in step S14 to the following equation (2):

$$TNET(N)=TCYL(N)+TTOTAL(N)-BFWF\times TWP(N) \quad (2)$$

where TTOTAL(N) is a total of all additive correction terms, such as an acceleration increment correcting term TACC, calculated according to the engine operating parameters supplied from the various sensors (it should be noted that TTOTAL(N) does not contain a dead period TV set according to a battery voltage for driving the fuel injection valve 6). TWP(N) is a fuel amount (estimated value) adhering to the intake pipe, which is calculated in the process shown in FIG. 10.

In the above equation, BFWF×TWP(N) is equivalent to an amount of fuel carried away from the fuel adhering to the intake pipe to the combustion chamber. Since a fuel amount equivalent to the carried-away fuel amount is not required to be newly injected, such a fuel amount is subtracted from the required fuel amount TCYL(N) in the equation (2).

In the subsequent step S16, it is determined whether or not the direct supply fuel amount TNET(N) is a positive value. If TNET(N) is less than or equal to "0", the fuel injection amount (the valve opening period of the fuel injection valve 6) TOUT is set to "0" (step S18). If TNET(N) is greater than "0", the fuel injection amount TOUT is calculated by dividing the direct supply fuel amount TNET(N) by the direct supply ratio AFWF in accordance with the following equation (3) (step S19). This is because only a part of the injected fuel amount which is expressed by TOUT×AFWF= TNET(N) is directly supplied to the combustion chamber.

$$TOUT=TNET(N)/AFWF \quad (3)$$

The ECU 5 outputs a command signal to the fuel injection valve 6 to be opened for a period determined by adding the dead period TV, which is set according to the battery voltage, to the fuel injection period TOUT calculated according to the equation (3), whereby a fuel amount equivalent to (TNET(N) +BFWF×TWP(N)=TCYL(N)+ TTOTAL(N)) is supplied to the combustion chamber.

Figure 10:
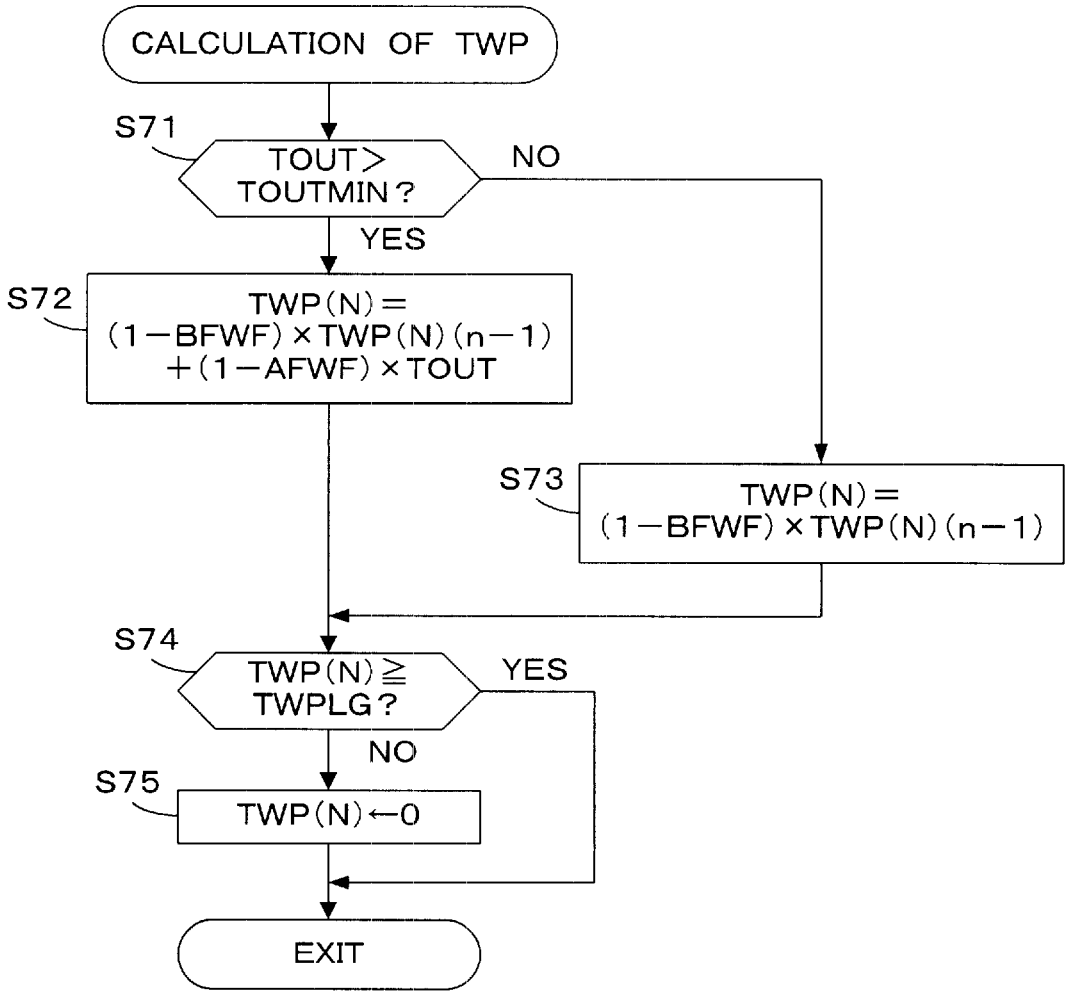
FIG. 10 is a flowchart of a process of calculating a fuel amount (TWP) adhering to an inner wall of an intake pipe.

In the subsequent step S19, the TWP calculating process shown in FIG. 10 is executed, to calculate an adhesion fuel amount TWP(N) which indicates an amount of fuel adhering to the intake pipe. Thereafter, the process shown in FIG. 2 is ended.

FIG. 3 is a flowchart of the TiMF calculating process executed in the step S12 shown in FIG. 2. In step S21, the startup basic fuel amount TiMST, a startup intake air temperature correction coefficient KTAST, a startup atmospheric pressure correction coefficient KPAST, and a startup engine coolant temperature correction coefficient KTWST, which are used for calculating a fuel supply amount suitable for startup of the engine, are calculated.

Specifically, the startup basic fuel amount TiMST is calculated by retrieving a startup basic fuel amount map (not shown) according to the engine rotational speed NE and the absolute intake pressure PBA. The startup basic fuel amount map is set so that the air-fuel ratio becomes optimum for startup of the engine in an operating condition corresponding to the set values of the engine rotational speed NE and the absolute intake pressure PBA.

Figure 4A:
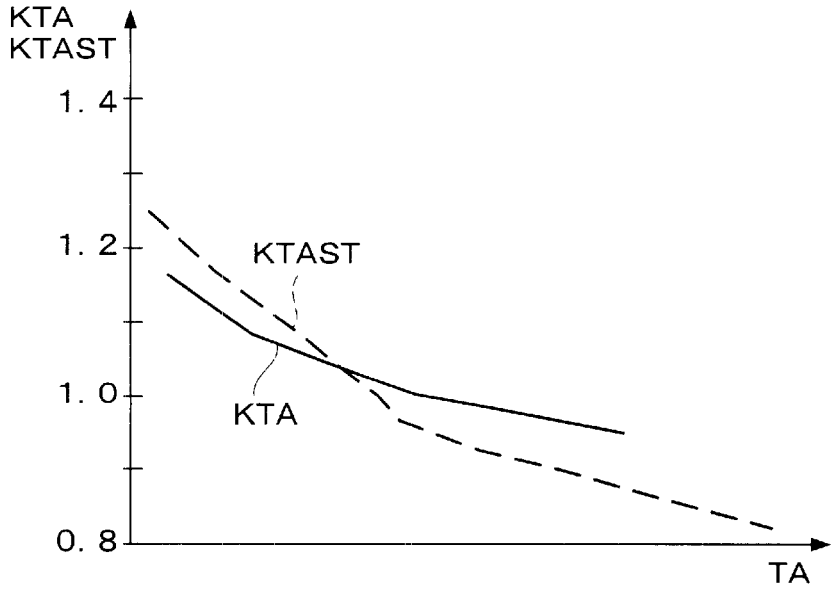
FIGS. 4A to 4C are graphs showing tables used for the process shown in FIG. 3.
Figure 4B:
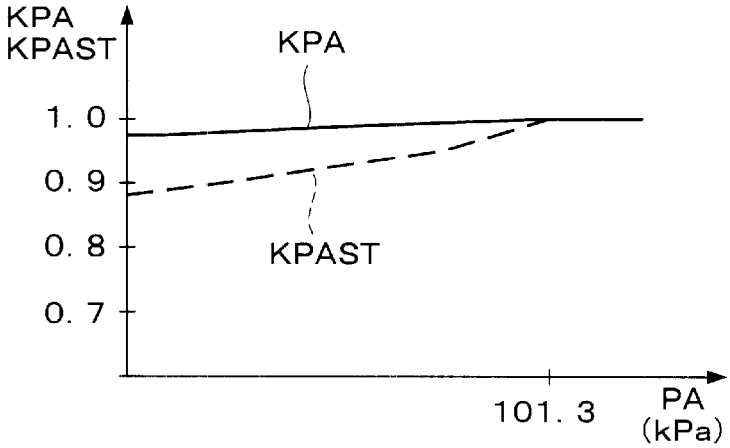
Figure 4C:
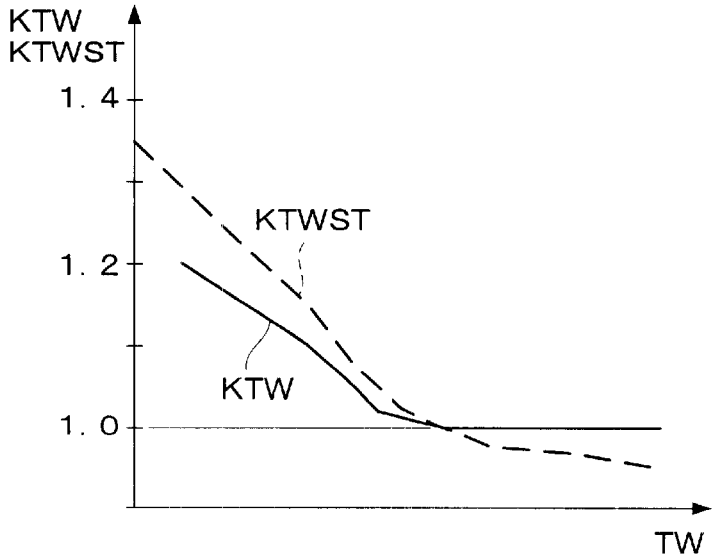

The startup intake air temperature correction coefficient KTAST is calculated by retrieving a KTAST table shown by a broken line in FIG. 4A according to the intake air temperature TA. The KTAST table is set so that the correction coefficient KTAST decreases with an increase in the intake air temperature TA. The startup atmospheric pressure correction coefficient KPAST is calculated by retrieving a KPAST table shown by a broken line in FIG. 4B according to the atmospheric pressure PA. The KPAST table is set so that the correction coefficient KPAST decreases with a decrease in the atmospheric pressure PA. The startup engine coolant temperature correction coefficient KTWST is calculated by retrieving a KTWST table shown by a broken line in FIG. 4C according to the engine coolant temperature TW. The KTWST table is set so that the correction coefficient KTWST decreases with an increase in the engine coolant temperature TW.

In the subsequent step S22, a modified startup basic fuel amount TiMSTM suitable for startup of the engine is calculated by applying the parameters calculated in step S21 to the following equation (4):

$$TiMSTM=TiMST\times KTAST\times KPAST\times KTWST \quad (4)$$

In step S23, an after-startup basic fuel amount TiM, an after-startup intake air temperature correction coefficient KTA, an after-startup atmospheric pressure correction coefficient KPA, and an after-startup engine coolant temperature correction coefficient KTW, which are used for calculating a fuel supply amount suitable for after completion of startup of the engine, that is, suitable for normal operation of the engine, are calculated.

Specifically, the after-startup basic fuel amount TiM is calculated by retrieving an after-startup basic fuel amount map (not shown) according to the engine rotational speed NE and the absolute intake pressure PBA. The after-startup basic fuel amount map is set so that an air-fuel ratio becomes a stoichiometric air-fuel ratio in each operating condition corresponding to the set values of the engine rotational speed NE and the absolute intake pressure PBA. The after-startup basic fuel amount (TiM) map is set so that the set values are suitable for after startup, that is, suitable for normal operation of the engine, and different from the set values of the startup basic fuel amount (TiMST) map, even in the same operating condition (that is, at the same engine rotational speed NE and absolute intake pressure PBA).

The after-startup intake air temperature correction coefficient KTA is calculated by retrieving a KTA table shown by a solid line in FIG. 4A according to the intake air temperature TA. The KTA table is set so that the correction coefficient KTA decreases with an increase in the intake air temperature TA, and that the correction coefficient KTA is smaller than the startup correction coefficient KTAST in a low temperature range and larger than the startup correction coefficient KTAST in a high temperature range. The after-startup atmospheric pressure correction coefficient KPA is calculated by retrieving a KPA table shown by a solid line in FIG. 4B according to the atmospheric pressure PA. The KPA table is set so that the correction coefficient KPA decreases with a decrease in the atmospheric pressure PA, and that the correction coefficient KPA is larger than the startup correction coefficient KPAST. The after-startup engine coolant temperature correction coefficient KTW is calculated by retrieving a KTW table shown by a solid line in FIG. 4C according to the engine coolant temperature TW. The KTW table is set so that the correction coefficient KTW decreases with an increase in the engine coolant temperature TW, and that the correcting efficient KTW is smaller than the startup correction coefficient KTWST in a low temperature range and is set to a value (1.0) which is larger than the startup correction coefficient KTWST in a high temperature range.

In the subsequent step S24, a modified after-startup basic fuel amount TiMM suitable for after-startup of the engine, that is, suitable for normal operation of the engine is calculated by applying the parameters calculated in step S23 in the following equation (5):

$$TiMM=TiM\times KTA\times KPA\times KTW \quad (5)$$

Figure 5:
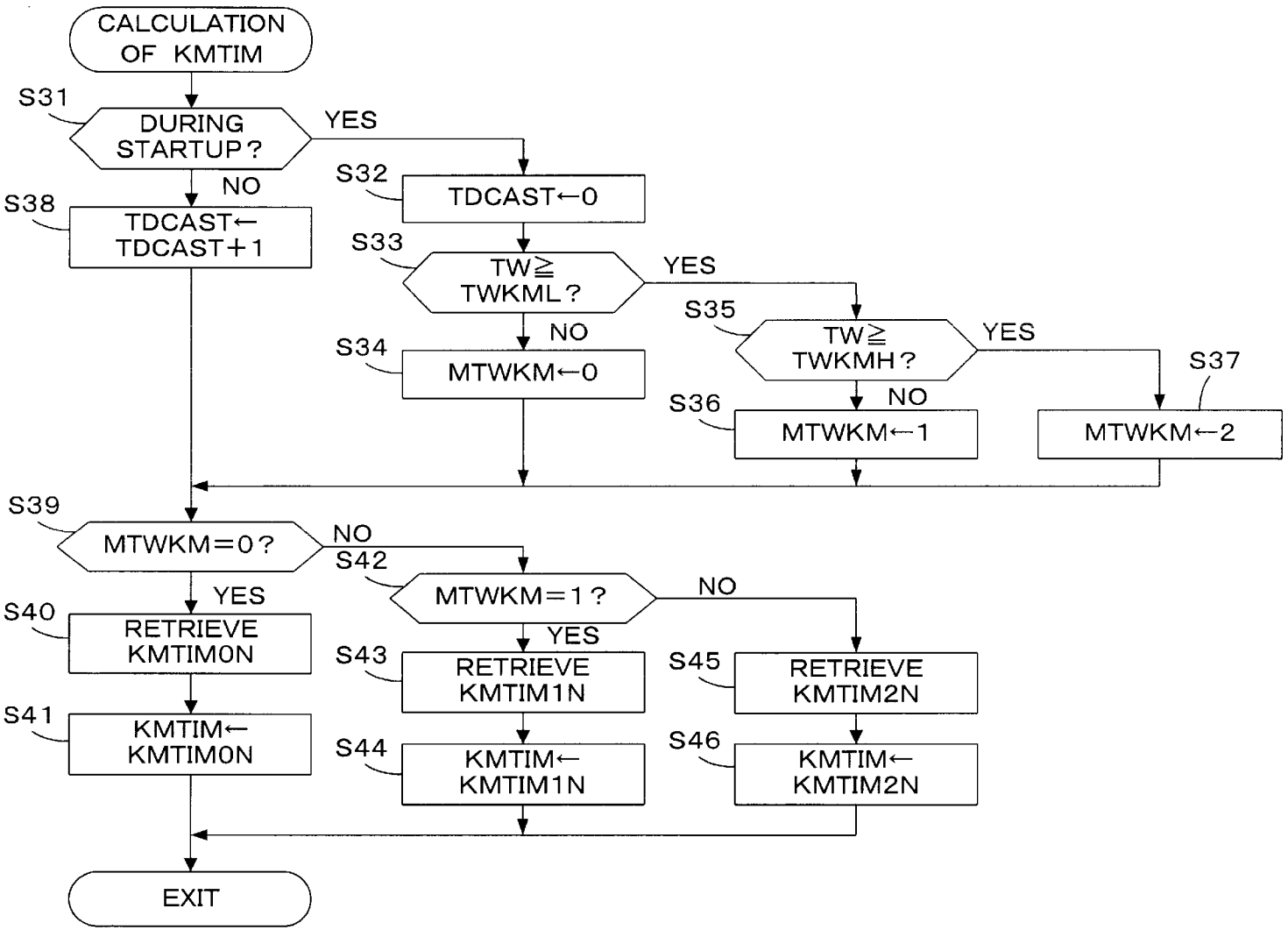
FIG. 5 is a flowchart of a process for calculating a transition coefficient (KMTIM)

In step S25, a KMTIM calculating process shown in FIG. 5 is executed, to calculate a transition coefficient KMTIM, which is gradually decreased with elapsed time after completion of startup of the engine, according to the engine coolant temperature TW during startup of the engine.

In step S26, the total basic fuel amount TiMF is calculated by applying the modified startup basic fuel amount TiMSTM and the modified after-startup basic fuel amount TiMM calculated in the above-described steps S22 and S24 to the following equation (6):

$$TiMF=TiMM\times(1-KMTIM)+TiMSTM\times KMTIM \quad (6)$$

In the above equation, during startup of the engine, the transition coefficient KMTIM is set to "1.0" to thereby set the total basic fuel amount TiMF to the modified startup basic fuel amount TiMSTM suitable for startup. In a transition control immediately after completion of startup, the transition coefficient KMTIM is gradually decreased, to thereby make the value of the total basic fuel amount TiMF smoothly change from the modified startup basic fuel amount TiMSTM to the modified after-startup basic fuel amount TiMM. After KMTIM becomes "0", the total basic fuel amount TiMF becomes equal to the modified after-startup basic fuel amount TiMM suitable for after-startup. Accordingly, both during startup and after startup, the fuel amount suitable for each operating condition is calculated, and the fuel amount is not rapidly changed at the time of completion of startup. As a result, it is possible to improve the accuracy of control of a fuel supply amount in a period from the beginning of startup to warm-up of the engine, and hence to allow the exhaust emission characteristic to fall within an extremely low level exhaust emission regulation.

It should be noted that, as will be described later, when the engine coolant temperature TW is relatively high, for example, upon hot restarting of the engine, the initial value of the transition coefficient KMTIM is set to a value smaller than "1.0", in order to make a termination timing of the transition to the normal control (the control in which TiMF is equal to TiMM) earlier.

FIG. 5 is a flowchart of the KMTIM calculating process executed in the step S25 shown in FIG. 3. In this process, the transition coefficient KMTIM is set according to the engine coolant temperature TW during startup.

In step S31, it is determined whether or not the engine is in startup, and if the engine is in startup, a TDC counter TDCAST for counting the generation number of the TDC pulses after completion of startup is set to "0" (step S32). It is determined whether or not the engine coolant temperature is higher than or equal to a first predetermined water temperature TWKML (e.g. 15° C.) (step S33). If TW is higher than or equal to TWKML in step S33, it is determined whether or not the engine coolant temperature TW is higher than or equal to a second predetermined water temperature TWKMH (e.g. 50° C.), which is higher than the first predetermined water temperature TWKML (step S35). As a result, if TW is lower than TWKML, a warm-up condition variable MTWKM indicating the warm-up condition of the engine is set to "0" (step S34). If TW is higher than or equal to TWKML and lower than TWKMH, the warm-up condition variable MTWKM is set to "1" (step S36). If TW is higher than or equal to TWKMH, the warm-up condition variable MTWKM is set to "2" (step S37). Thereafter, the process goes to step S39.

If it is determined in step S31 that the engine is not in startup, that is, after completion of startup, the TDC counter TDCAST is incremented by "1" (step S38), the process goes on to step S39.

In step S39, it is determined whether or not the warm-up condition variable MTWKM is "0". If MTWKM is greater than "0", it is determined whether or not the value of MTWKM is "1" (step S42). If MTWKM is equal to "0", a low temperature transition coefficient value KMTIM0N suitable for a low temperature is calculated by retrieving a KMTIM0N table shown in FIG. 9A according to the value of the TDC counter TDCAST (step S40), and the transition coefficient KMTIM is set to the low temperature transition coefficient value KMTIM0N (step S41). The KMTIM0N table is set so that the transition coefficient value KMTIM0N is "1.0" when TDCAST=0, and is decreased to "0" with an increase in the value of the TDC counter TDCAST, that is, with elapsed time after completion of startup.

Figure 9A:
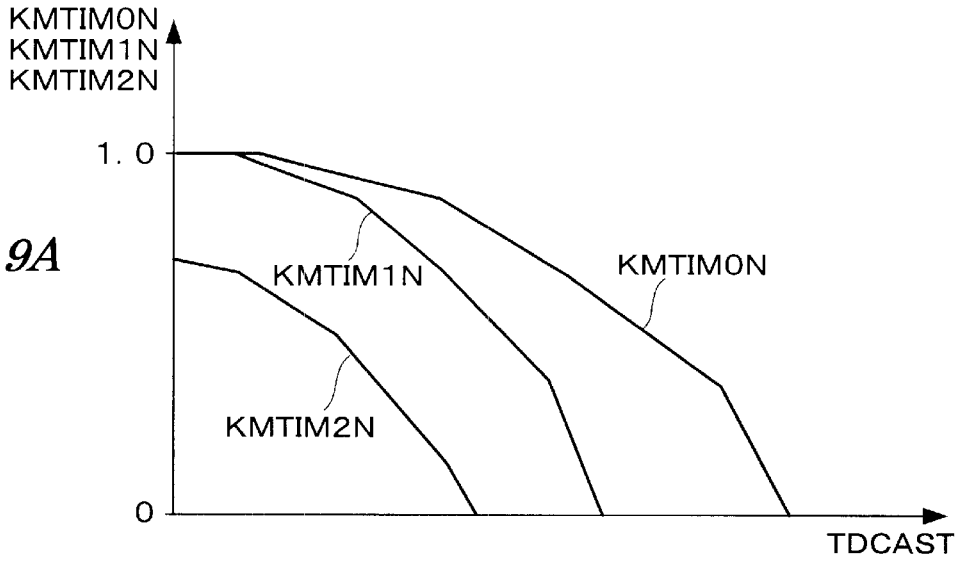
FIGS. 9A and 9B are graphs showing tables used for the process shown in FIG. 5 or the process shown in FIG. 6.

If MTWKM is "1", an intermediate temperature transition coefficient value KMTIM1N suitable for an intermediate temperature is calculated by retrieving a KMTIM1N table shown in FIG. 9A according to the value of the TDC counter TDCAST (step S43), and the transition coefficient KMTIM is set to the intermediate temperature transition coefficient value KMTIM1N (step S44). The KMTIM1N table is set so that the transition coefficient value KMTIM1N is "1.0" when TDCAST is "0", and is decreased to "0" with an increase in a value of the TDC counter TDCAST, that is, with elapsed time after completion of startup. The KMTIM1N table is set so that the transition coefficient decreasing rate, that is, the rate at which the set value decreases, is faster than that of the KMTIM0N table.

If MTWKM is "2", a high temperature transition coefficient value KMTIM2N suitable for a high temperature is calculated by retrieving KMTIM2N table shown in FIG. 9A according to the value of the TDC counter TDCAST (step S45), and the transition coefficient KMTIM is set to the high temperature transition coefficient value KMTIM2N (step S46). The KMTIM2N table is set so that the transition coefficient value KMTIM2N is set to a predetermined value smaller than "1.0" when TDCAST is "0", and is decreased to "0" with an increase in a value of the TDC counter TDCAST, that is, with elapsed time after completion of startup. The KMTIM2N table is set so that the transition coefficient value reaches "0" at a time earlier than a time at which the transition coefficient value set in the KMTIM1N table reaches "0".

As is apparent from the above description, by executing the process shown in FIG. 5, the transition coefficient KMTIM is set so that the transition rate is made faster or the transition termination timing is made earlier as the engine coolant temperature TW during startup is higher. Accordingly, by applying the transition coefficient KMTIM in equation (6), it is possible to execute the transition control suitable for the engine temperature during startup and hence to improve the accuracy of the fuel supply amount control.

FIG. 6 is a flowchart of the adhesion correction parameter calculating process in the step S13 shown in FIG. 2.

Figure 7A:
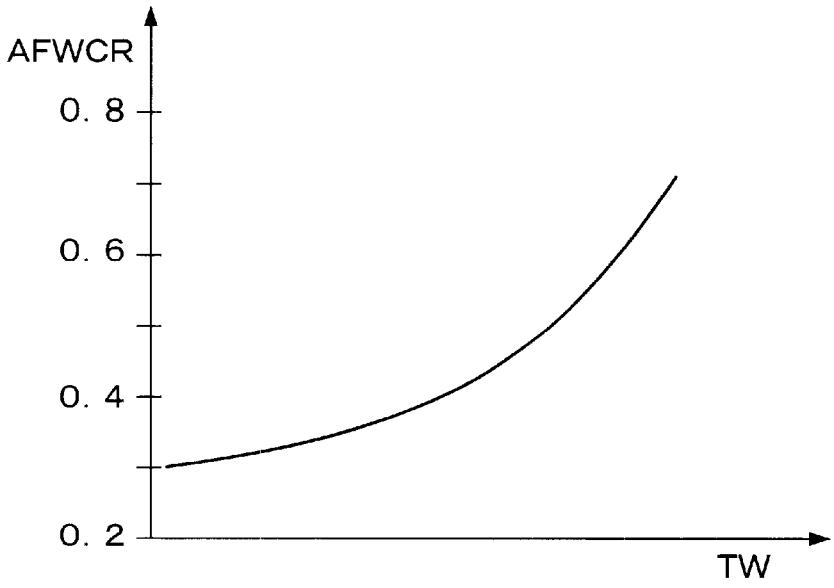
FIGS. 7A and 7B are graphs showing tables used for the process shown in FIG. 6.
Figure 7B:
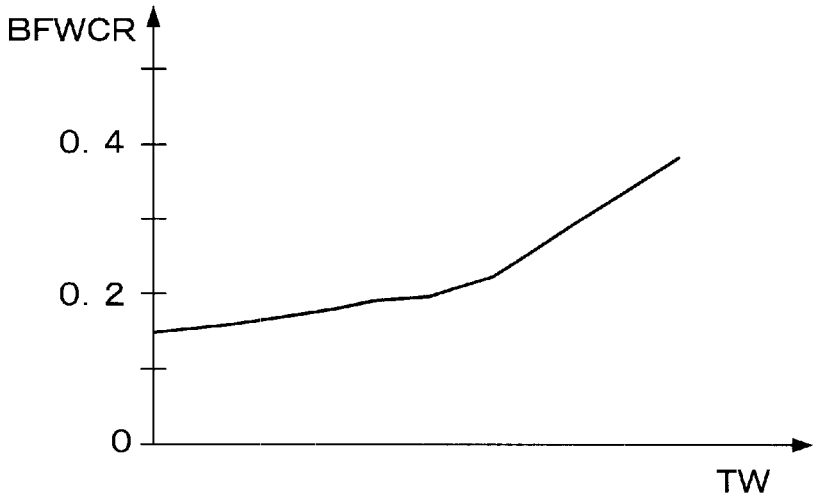

In step S51, it is determined whether or not the engine 1 is in startup, and if the engine is in startup, the startup direct supply ratio AFWCR and the startup carried-away ratio BFWCR are calculated by retrieving the AFWCR table shown in FIG. 7A and the BFWCR table shown in FIG. 7B according to the engine coolant temperature TW (step S52), and the process goes to step S55. The AFWCR table and the BFWCR table are set so that the direct supply ratio AFWCR and the carried-away ratio BFWCR are increased with an increase in the engine coolant temperature TW.

Figure 8A:
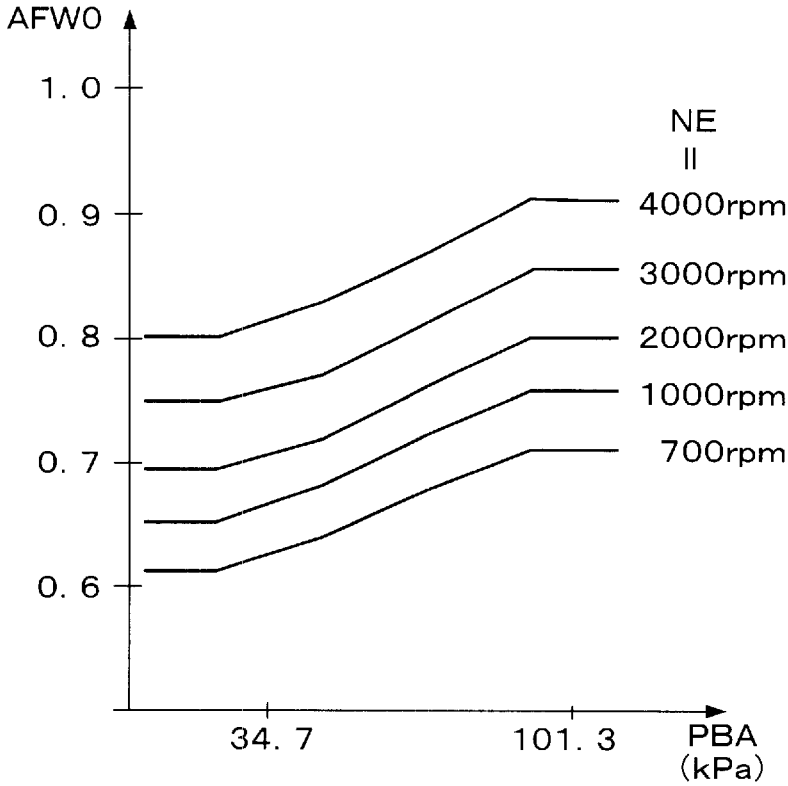
FIGS. 8A and 8B are graphs showing maps used for the process shown in FIG. 6.
Figure 8B:
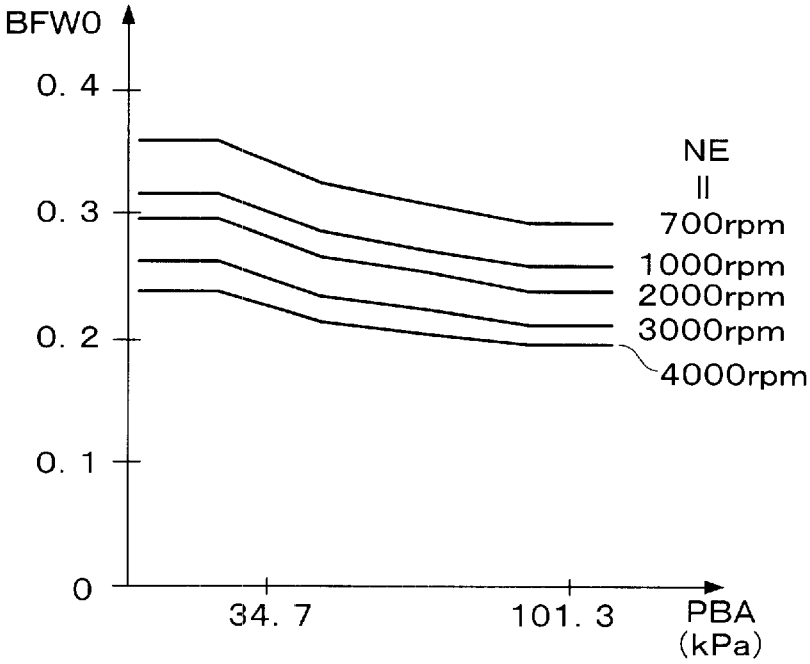

If the engine 1 is not in startup, that is, after completion of startup, a map value AFW0 of the direct supply ratio and a map value BFW0 of the carried-away ratio are calculated by retrieving the AFW0 map shown in FIG. 8A and the BFW0 map shown in FIG. 8B according to the engine rotational speed NE and the absolute intake pressure PBA (step S53). The AFW0 map is set so that the map value AFW0 is increased as the absolute intake pressure PBA becomes higher and the engine rotational speed NE becomes higher. The BFW0 map is set so that the map value BFW0 is decreased as the absolute intake pressure PBA becomes higher and the engine rotational speed NE becomes higher.

In the subsequent step S54, a temperature correction coefficient KATW of the direct supply ratio and a temperature correction coefficient KBTW of the carried-away ratio are calculated according to the engine coolant temperature TW, and the process goes to step S55. These correction coefficients are set to be increased as the engine coolant temperature TW becomes higher.

Figure 9B:
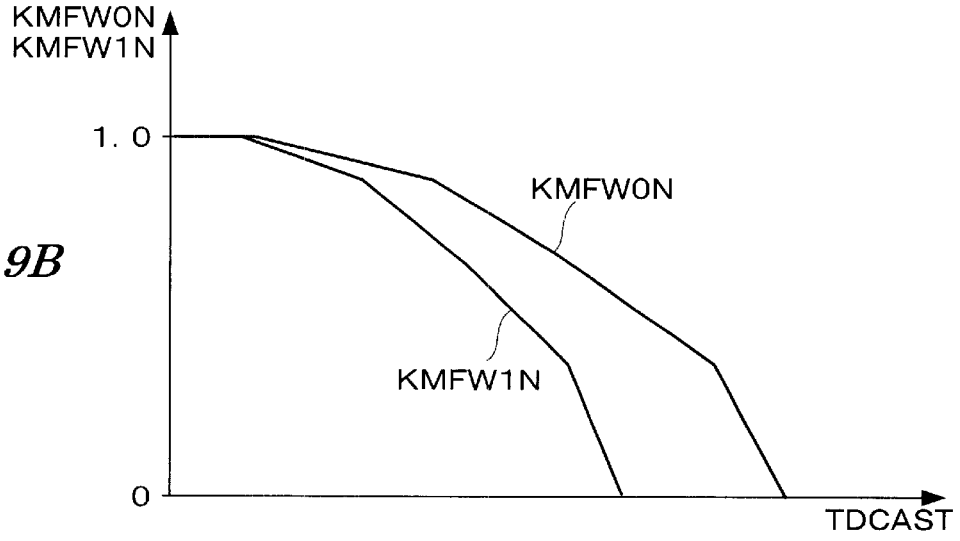

In step S55, it is determined whether or not the warm-up condition variable MTWKM calculated by the process shown in FIG. 5 is "0", and if MTWKM is "0", a low temperature transition coefficient value KMFW0N suitable for a low temperature is calculated by retrieving the KMFW0N table shown in FIG. 9B according to a value of the TDC counter TDCAST (step S56). The KMFW0N table is set so that the transition coefficient value KMFW0N is "1.0" when TDCAST is "0", and is decreased to "0" with an increase in a value of the TDC counter TDCAST, that is, with elapsed time after completion of startup. In the subsequent step S57, the transition coefficient KMFW is set to the low temperature transition coefficient value KMFW0N. Thereafter, the process goes to step S60.

If MTWKM=1 or 2 in step S55, a high temperature transition coefficient value KMFW1N suitable for a high temperature is calculated by retrieving a KMFW1N table shown in FIG. 9B according to a value of the TDC counter TDCAST (step S58). The KMFW1N table is set so that the transition coefficient value KMFW1N is set to "1.0" when TDCAST is "0", and is decreased to "0" with an increase in a value of the TDC counter TDCAST, that is, with elapsed time after completion of startup. The KMFW1N table is set so that the rate at which the set value decreases, that is, the transition coefficient decreasing rate, is faster than that of the KMFW0N table. In the subsequent step S59, the transition coefficient KMFW is set to the high temperature transition coefficient value KMFW1N. Thereafter, the process goes to step S60.

In step S60, it is determined whether or not the transition coefficient KMFW is "0". If KMFW is greater than "0", the process immediately goes to step S62. If KMFW is "0", the process goes to step S62 by way of step S61 in which a transition control flag FKMSTFW is set to "0". The transition control flag FKMSTFW is set to "1" in a period from startup of the engine to completion of the transition control.

In step S62, it is determined whether or not the transition control flag FKMSTFW is "1". If FKMSTFW=1, a total direct supply ratio AFWF and a total carried-away ratio BFWF are calculated by applying the startup direct supply ratio AFWCR and startup carried-away ratio BFWCR calculated in step S52, the map value AFW0 of the after-startup direct supply ratio and the map value BFW0 of the after-startup carried-away ratio calculated in step S53, the temperature correction coefficients KATW and KBTW calculated in step S54, and the transition coefficient KMFW set in step S57 or S59, to the following equations (7) and (8) (steps S63 and S64):

$$AFWF=AFW0\times KATW\times(1-KMFW)+AFWCR\times KMFW \quad (7)$$

$$BFWF=BFW0\times KBTW\times(1-KMFW)+BFWCR\times KMFW \quad (8)$$

After calculation according to the equations (7) and (8), the process shown in FIG. 6 is ended.

If FKMSTFW is "0" in step S62, which indicates that the transition control is ended, the total direct supply ratio AFWF is set to a value obtained by multiplying the temperature correction coefficient KATW by the map value AFW0, and the total carried-away ratio BFWF is set to a value obtained by multiplying the temperature correction coefficient KBTW by the map value BFW0 (step S65). Thereafter, the process shown in FIG. 6 is ended.

As is apparent from the above description, according to the process shown in FIG. 6, during startup of the engine, the transition coefficient KMFW is set to "1", and the total direct supply ratio AFWF and the total carried-away BFWF are substantially set respectively to the startup direct supply ratio AFWCR and the startup carried-away ratio BFWCR, which are the startup adhesion correction parameters. In the transition control immediately after completion of startup, the total direct supply ratio AFWF and the total carried-away ratio BFWF are set to smoothly change to the after-startup direct supply ratio (AFW0×KATW) and the after-startup carried-away ratio (BFW0×KBTW), respectively by gradually decreasing the transition coefficient KMFW. Further, after completion of the transition control, the total direct supply ratio AFWF and the total carried-away ratio BFWF are set respectively to the after-startup direct supply ratio (AFW0×KATW) and the after-startup carried-away ratio (BFW0×KBTW). Accordingly, both during startup and after startup, the adhesion corrections suitable for respective operating conditions are performed, and the adhesion correction parameters are not rapidly changed at the time of completion of startup. As a result, it is possible to more accurately control a fuel supply amount in view of the fuel adhering to the inner wall of the intake pipe.

It should be noted that it is preferable to use the AFW0 map and BFW0 map for calculating the after-startup direct supply ratio and the after-startup carried-away ratio which are set differently depending on whether the selected valve timing is a high speed valve timing or a low speed valve timing.

FIG. 10 is a flowchart of the TWP calculating process executed in the step S19 shown in FIG. 2.

In step S71, it is determined whether or not the fuel injection amount TOUT calculated in step S17 or S18 shown in FIG. 2 is larger than a predetermined minimum value TOUTMIN, and if TOUT is greater than TOUTMIN, an adhesion fuel amount TWP(N) is calculated according to the following equation (9) (step S72):

$$TWP(N)=(1-BFWF)\times TWP(N)(n-1)+(1-AFWF)\times TOUT \quad (9)$$

In the above equation, TWP(N)(n−1) is a preceding value of the adhesion fuel amount TWP(N). The first term on the right side is equivalent to the amount of fuel which is a part of the fuel having adhered in the preceding cycle and is not carried away (that is, remaining) in the present cycle. The second term on the right side is equivalent to the amount of fuel which is a part of the fuel injected in the present cycle and has newly adhered to the intake pipe.

If TOUT is less than or equal to TOUTMIN in step S71, which indicates that the amount of fuel injected is small or not injected at all, the adhesion fuel amount TWP(N) is calculated according to the following equation (10) (step S73):

$$TWP(N)=(1-BFWF)\times TWP(N)(n-1) \quad (10)$$

The equation (10) corresponds to an equation obtained by canceling the second term of the equation (9). The reason why the second term is canceled is that no fuel adheres to the intake pipe when the injected fuel amount is extremely small.

After execution of step S72 or S73, the process goes to step S74 in which it is determined whether or not the adhesion fuel amount TWP(N) calculated in step S72 or S73 is greater than or equal to a predetermined guard value TWPLG The guard value TWPLG is set to a very small value near zero. If TWP(N) is less than TWPLGC the adhesion fuel amount TWP(N) is set to "0" (step S75). If TWP(N) is greater than or equal to TWPLG, the process shown in FIG. 10 is immediately ended.

According to the process shown in FIG. 10, it is possible to obtain an accurate adhesion fuel amount TWP(n) (estimated value) by calculating the adhesion fuel amount TWP(N) by using the fuel injection amount TOUT and the adhesion correction parameters AFWF and BFWF, to thereby accurately control the fuel amount to be supplied to each cylinder.

According to this embodiment, steps S21 and S22 in FIG. 3, step S52 in FIG. 6, and steps S14 to S19 in FIG. 2 correspond to the startup fuel amount calculating means. Steps S23 and S24 in FIG. 3, steps S53 and S54 in FIG. 6, and steps S14 to S19 in FIG. 2 correspond to the after-startup fuel amount calculating means. Steps S25 and S26 in FIG. 3, and steps S55 to S64 in FIG. 6 correspond to the transition control means. Further, Step S52 in FIG. 6 and steps S15, S17, and S19 in FIG. 2, which are contained in the startup fuel amount calculating means, correspond to the startup adhesion correcting means. Steps S53 and 54 in FIG. 6 and step S15, S17 and S19 in FIG. 2, which are contained in the after-startup fuel amount calculating means, correspond to the after-startup adhesion correcting means.

Although in the above-described embodiment the transition coefficient KMTIM used for transition of the basic fuel amount is set to be different from the transition coefficient KMFW used for transition of the adhesion correction parameter, it may be set to be the same as the transition coefficient KMFW.

Each of the transition coefficients KMTIM and KMFW, which is set according to the number of the TDC signal pulses after completion of startup in the above-described embodiment, may be set according to elapsed time after completion of startup, which is counted by a timer.

Although the engine coolant temperature TW is used as the parameter representative of the engine temperature in the above-described embodiment, a detection value of the temperature of engine oil may be used as the parameter representative of the engine temperature.

In the above-described embodiment, the modified startup basic fuel amount TiMSTM and the modified after-startup basic fuel amount TiMM are calculated respectively by correcting the basic fuel amounts TiMST and TiM according to the intake air temperature TA, the atmospheric pressure PA and the engine coolant temperature TW. The fuel amount TiMSTM and TiMM may be calculated by correcting the basic fuel amounts TiMST and TiM according to one or two of the intake air temperature TA, the atmospheric pressure PA, and the engine coolant temperature TW.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A fuel supply control system for an internal combustion engine comprising:

startup fuel amount calculating means for calculating, during startup of the engine, a fuel amount to be supplied to the engine according to a start fuel amount calculating method;

after-startup fuel amount calculating means for calculating, after startup of the engine, a fuel amount to be supplied to the engine according to an after-startup fuel amount calculating method; and fuel supply means for supplying the fuel amount calculated by said startup fuel amount calculating means to said engine during startup of said engine, and supplying the fuel amount calculated by said after-startup fuel amount calculating means to said engine after startup of said engine;

wherein said fuel supply means includes transition control means for smoothly performing a transition from the fuel amount calculated by said startup fuel amount calculating means to the fuel amount calculated by said after-startup fuel amount calculating means, and said transition control means smoothly performs said transition by correcting each of the fuel amount calculated by said startup fuel amount calculating means and the fuel amount calculated by said after-startup fuel amount calculating means, using a transition coefficient, the transition coefficient varying with elapsed time, and the transition coefficient being set according to the temperature of said engine, and the fuel supply control system includes an intake pipe wherein fuel is supplied to said engine through said intake pipe and wherein said startup fuel amount calculating means and said after-startup fuel amount calculating means respectively include startup adhesion correcting means and after-startup adhesion correcting means for correcting for a delay in the transfer of fuel due to adhesion of a portion of the supplied fuel to an inner wall of said intake pipe said startup adhesion correcting means correcting the fuel amount using startup adhesion correction parameters and said after-startup adhesion correcting means correcting the fuel amount using after-startup adhesion correction parameters, set independently from the startup adhesion correction parameters, said transition control means correcting the startup adhesion correction parameters and the after-startup adhesion correction parameters using a transition coefficient varying with elapsed time thereby smoothly performing the transition from the startup adhesion correction parameters to the after-startup adhesion correction parameters.

2. A fuel supply control system, for an internal combustion engine comprising:

startup fuel amount calculating means for calculating, during startup of the engine, a fuel amount to be supplied to the engine according to a start fuel amount calculating method;

after-startup fuel amount calculating means for calculating, after startup of the engine, a fuel amount to be supplied to the engine according to an after-startup fuel amount calculating method; and fuel supply means for supplying the fuel amount calculated by said startup fuel amount calculating means to said engine during startup of said engine, and supplying the fuel amount calculated by said after-startup fuel amount calculating means to said engine after startup of said engine;

wherein said fuel supply means includes transition control means for smoothly performing a transition from the fuel amount calculated by said startup fuel amount calculating means to the fuel amount calculated by said after-startup fuel amount calculating means, and said transition control means smoothly performs said transition by correcting each of the fuel amount calculated by said startup fuel amount calculating means and the fuel amount calculated by said after-startup fuel amount calculating means, using a transition coefficient, the transition coefficient varying with elapsed time, and wherein transition control means sets the transition coefficient according to the temperature of the engine and said transition control means sets the transition coefficient such that the transition rate becomes faster as the temperature of the engine becomes higher.

3. A fuel supply control system according to claim 2, wherein said transition control means sets said transition coefficient such that the completion timing of the transition is earlier as the temperature of the engine becomes higher.

4. A fuel supply control system for an internal combustion engine comprising:

startup fuel amount calculating means for calculating, during startup of the engine, a fuel amount to be supplied to the engine according to a start fuel amount calculating method;

after-startup fuel amount calculating means for calculating, after startup of the engine, a fuel amount to be supplied to the engine according to an after-startup fuel amount calculating method; and fuel supply means for supplying the fuel amount calculated by said startup fuel amount calculating means to said engine during startup of said engine, and supplying the fuel amount calculated by said after-startup fuel amount calculating means to said engine after startup of said engine;

wherein said fuel supply means includes transition control means for smoothly performing a transition from the fuel amount calculated by said startup fuel amount calculating means to the fuel amount calculated by said after-startup fuel amount calculating means, said fuel supply control system including means for sensing engine rotational speed, means for sensing engine intake pressure, means for sensing intake air temperature, means for sensing atmospheric pressure and means for sensing engine temperature, and wherein said startup fuel amount calculating means calculates a modified startup basic fuel amount by correcting a startup basic fuel amount set according to the engine rotational speed and the intake pressure, using at least one of a startup intake air temperature correction coefficient set according to the intake air temperature, a startup atmospheric pressure correction coefficient set according to the atmospheric pressure, and a startup engine temperature correction coefficient set according to the engine temperature, and calculates the fuel amount to be supplied to said engine during startup using said modified startup basic fuel amount; and said after-startup fuel amount calculating means calculates a modified after-startup basic fuel amount by correcting an after-startup basic fuel amount set according to the engine rotational speed and the intake pressure, using at least one of an after-startup intake air temperature correction coefficient set according to the intake air temperature, an after-startup atmospheric pressure correction coefficient set according to the atmospheric pressure, and an after-startup engine temperature correction coefficient set according to the engine temperature, and calculates said fuel amount to be supplied to the said engine after startup using the modified after-startup basic fuel amount.

5. A fuel supply control system according to claim 4, wherein said transition control means smoothly performs the transition from the modified startup basic fuel amount to the modified after-startup basic fuel amount using the transition coefficient varying with elapsed time.

* * * * *